US006325229B1

(12) United States Patent
Anders

(10) Patent No.: US 6,325,229 B1
(45) Date of Patent: Dec. 4, 2001

(54) CONTAINER COIL HAVING MULTIPLE DISCREET COMPARTMENTS

(76) Inventor: Stuart Anders, 1121 Stonewood Crossing, Sun Prairie, WI (US) 53590

( * ) Notice: Subject to any disclaimer, the term of this patent is extended or adjusted under 35 U.S.C. 154(b) by 0 days.

(21) Appl. No.: 09/785,980

(22) Filed: Feb. 20, 2001

(51) Int. Cl.[7] ..... B65D 1/04
(52) U.S. Cl. ..... 220/23.4; 220/4.27; 215/6
(58) Field of Search ..... 220/23.4, 23.83, 220/4.27; 215/6

(56) References Cited

U.S. PATENT DOCUMENTS 5,316,159 * 5/1994 Douglas et al. ..... 220/23.4 X
5,735,422 * 4/1998 Binter ..... 220/4.27 X
5,823,391 * 10/1998 Klauke et al. ..... 220/4.27 X
5,954,213 * 9/1999 Gerhart et al. ..... 215/6 X
6,179,146 * 1/2001 Betras ..... 220/23.4

* cited by examiner

*Primary Examiner*—Steven Pollard
(74) *Attorney, Agent, or Firm*—Richard S. Ross, Esq.

(57) ABSTRACT

An ensemble of discrete containers wherein each of the containers is spiral wound along a common axis, so as to provide a symmetrical geometric form or ensemble comprising a novelty item, a toy or packaging ensemble for related products/materials. In one of the preferred embodiments of the invention, the containers comprise an ensemble of beverage bottles wherein the open end of the necks of each container of the ensemble is provided with a separate closure. The individual containers of the ensemble are, thus, entwined about one another so as to provide the requisite degree of torsional engagement of each other to hold the resulting ensemble together. The discrete containers of the ensemble can be further provided with releasable, interlocking features (e.g. mating pairs of male and female surface features), to further engage and maintain the contiguous containers of the ensemble within a unitary configuration.

18 Claims, 7 Drawing Sheets

CONTAINER COIL HAVING MULTIPLE DISCREET COMPARTMENTS

BACKGROUND OF THE INVENTION

1. Field of the Invention

This invention relates to an article of manufacture. More specifically, this invention is directed to multiple discreet containers arranged in a spiral wound interlocking ensemble.

2. Background of Invention

The packaging of beverages, industrial products and consumer goods, particularly, fluid materials can typically involve packaging concepts having both functional and ornamental qualities. Where such materials are related to one another by virtue of their interaction or conjunct usage, they can be packaged and sold in a single commercial unit. For example, in the industrial sector, there are numerous chemical products that are adapted to be mixed together at the time of use, but are preferably packaged individually so that they remain separated until used. One such example are the epoxy resins and the catalysts or activators that cause such resins to harden or polymerize.

Another product combination in, for example, the consumer product area, is the unitary packaging of the ingredients for various recipes, (e.g. salad dressing, baked goods, etc.) where the objective of the manufacturer is to have such ingredients combined immediately prior to consumption or cooking/baking. In each instance, the packaging of such ingredients in each of the individuals containers is accomplished independently, and, thereafter, the combination of packages combined in a single commercial unit.

Under certain circumstances, its may also be desirable to provide such companion products in decorative serving containers, that can be used directly by the consumer at the time of dispensing of the contents of the companion products. Where this latter option is desired, it is preferable that the companion products be similar or complimentary; and, to the extent possible, that each of the containers for each of the companion products be physically associated with one another, so as to provide an integral unit or ensemble. The latter criteria is desirable to provide an attractive item that can be used, or allowed to remain in plain view, while avoiding the appearance of clutter or disorder. With respect to this latter requirement, there is and remains a continuing need to provide such functional and ornamental packaging concepts that are both cost effective and suitable for use in conjunction with a broad range of companion products.

OBJECTS OF THE INVENTION

It is the object of this invention to remedy the above as well as related deficiencies in the prior art.

More specifically, it is the principal to provide a unitary array of multiple containers for packaging of related or similar goods wherein each of the containers is integral with each other so as to provide an attractive and functional ensemble.

It is another object of this invention to provide a unitary array of multiple containers for packaging of related or similar goods wherein each of the containers of the array are arranged relative to one another along a common axis.

It is yet another object of this invention to provide a unitary array of multiple containers for packaging of related or similar goods wherein each of the containers of the array contribute to a geometrically symmetrical form having an axis in common to each container, so as to interlock said containers into said geometrically symmetrical form.

SUMMARY OF THE INVENTION

The above and related objects are achieved by providing an array of containers of essentially the same size and shape, wherein each of the containers of such array comprise a symmetrical geometric form which contribute to an ensemble of such containers having a single axis in common to each of the containers of the ensemble.

In the preferred embodiments of this invention, each of the containers is spiral wound along a common vertical axis, so as to provide a symmetrical geometric form or ensemble having a base, and intermediate section, and neck, wherein the open end of the neck of each container of the ensemble is provided with a separate closure. The individual containers of the ensemble are thus entwined about one another so as to provide the requisite degree of torsional engagement of one to the other so as to hold the resulting ensemble together. In practice, in excess of 270°, and most preferably, at least about 360° of torsional engagement of the discrete containers relative to one another, provides adequate physical coupling together of the independent, discrete containers to maintain the integrity of the resulting ensemble. The discrete containers of the ensemble can be further provided with releasable, interlocking features (e.g. mating pairs of male and female surface features), to maintain the contiguous containers of the ensemble within a unitary configuration.

In another of the preferred embodiments of this invention, the ensemble can have a flattened base to maintain it in an erect posture and thereby a fixed orientation relative to a surface, so as to provide stability of orientation of the ensemble on such surface. Where the ensemble is to be used to as a novelty item, a toy or simply to adorn a table or other item of furniture, it can include several free-form like containers, each of which may be either free standing or otherwise dependent upon the other members of the ensemble for stability.

DETAILED DESCRIPTION OF THE INVENTION INCLUDING PREFERRED EMBODIMENTS

The Figures which accompany this application, and referenced herein, depict representative ensembles of this invention. In the embodiments of this invention illustrated in these Figures, each of the ensembles comprises a pair of identical spiral wound forms positioned relative to one another along a common vertical axis. The individual containers of the ensemble are, thus, entwined about one another so as to provide the requisite degree of torsional engagement to hold the resulting ensemble together.

The individual containers of the ensembles of this invention can be typically fabricated from any thermoplastic materials (naturally occurring or synthetic resin or glass) that lends itself to formation of intricate and free-form shapes. In the preferred embodiments of this invention, the individual containers are fabricated by standard injection molding, blow molding, or rotational casting techniques. The intricacies of the individual container shape, and the material's choice for their fabrication, may well determine/limit the fabrication method. In the preferred embodiments of this invention, virtually any of the common thermoplastic material, (e.g. vinyl resins, styrenic resins, polyethylene teraphthalate (PET), and their respective blends, copolymers and compounds), are contemplated for the fabrication of the containers of the ensembles of this invention. The molds used in the forming of the containers contemplated for use herein, would preferably have a three (3) dimensional parting line, and, thus, not require slides or cams to free the form from the mold.

Figure 1:
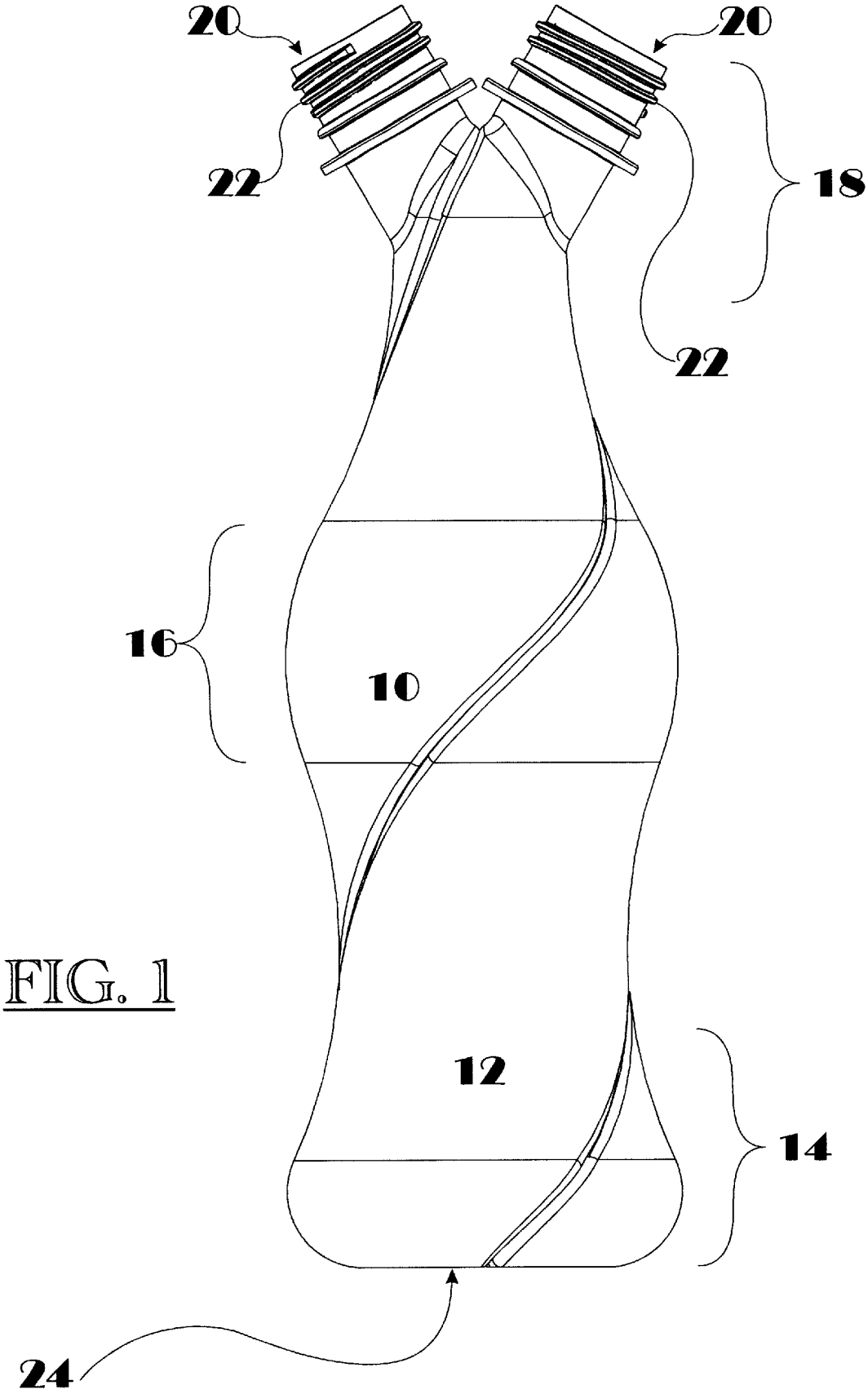
FIG. 1 is a perspective view of a symmetrical geometric form or ensemble of two containers wherein each of the containers of the ensemble is arranged along a common vertical axis of the ensemble.
Figure 3:
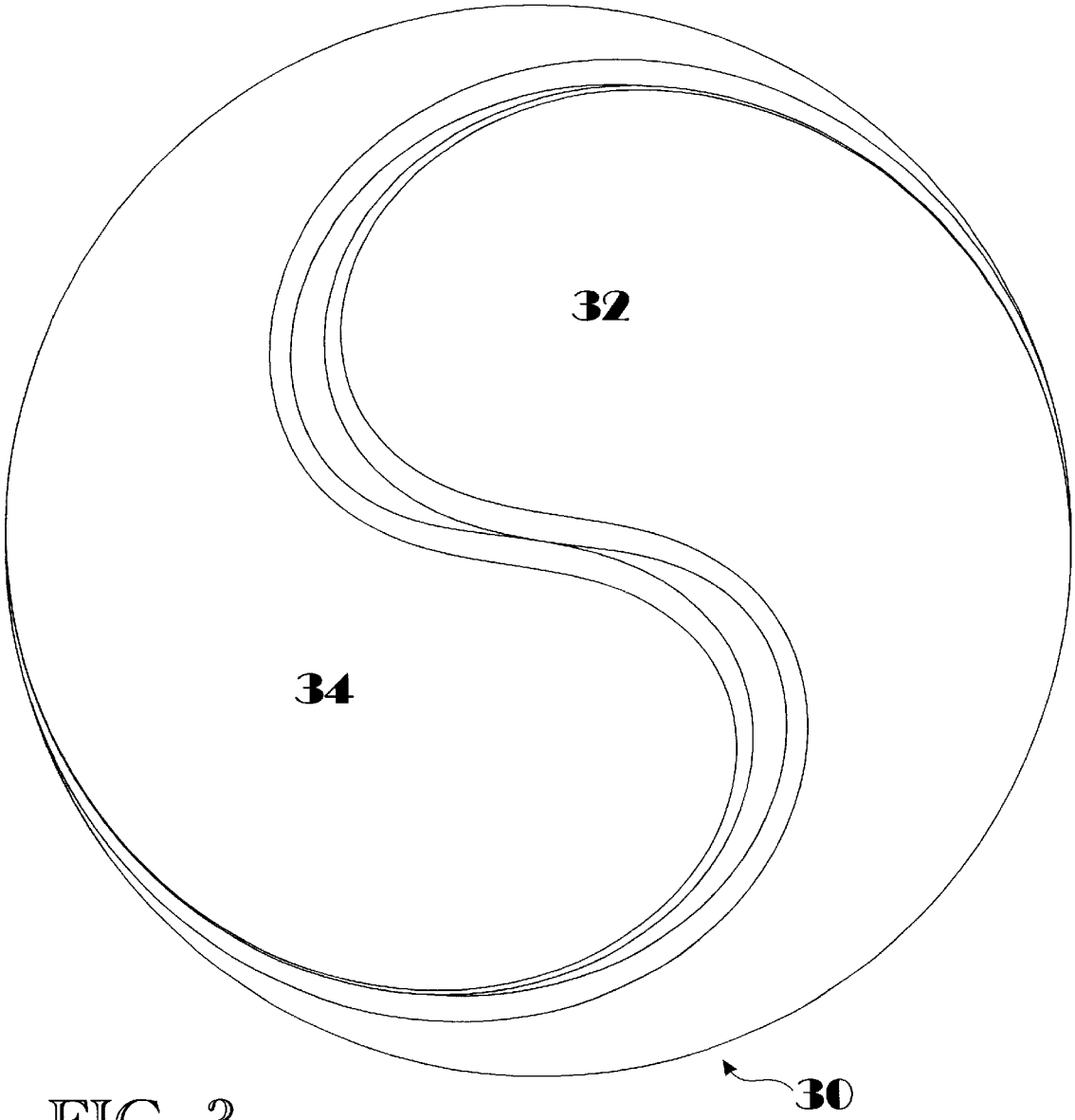
FIG. 3 is a perspective view of a globe (e.g. toy or novelty item) comprising two containers wherein each of the containers of the globe is arranged along a common vertical axis of the ensemble.
Figure 5:
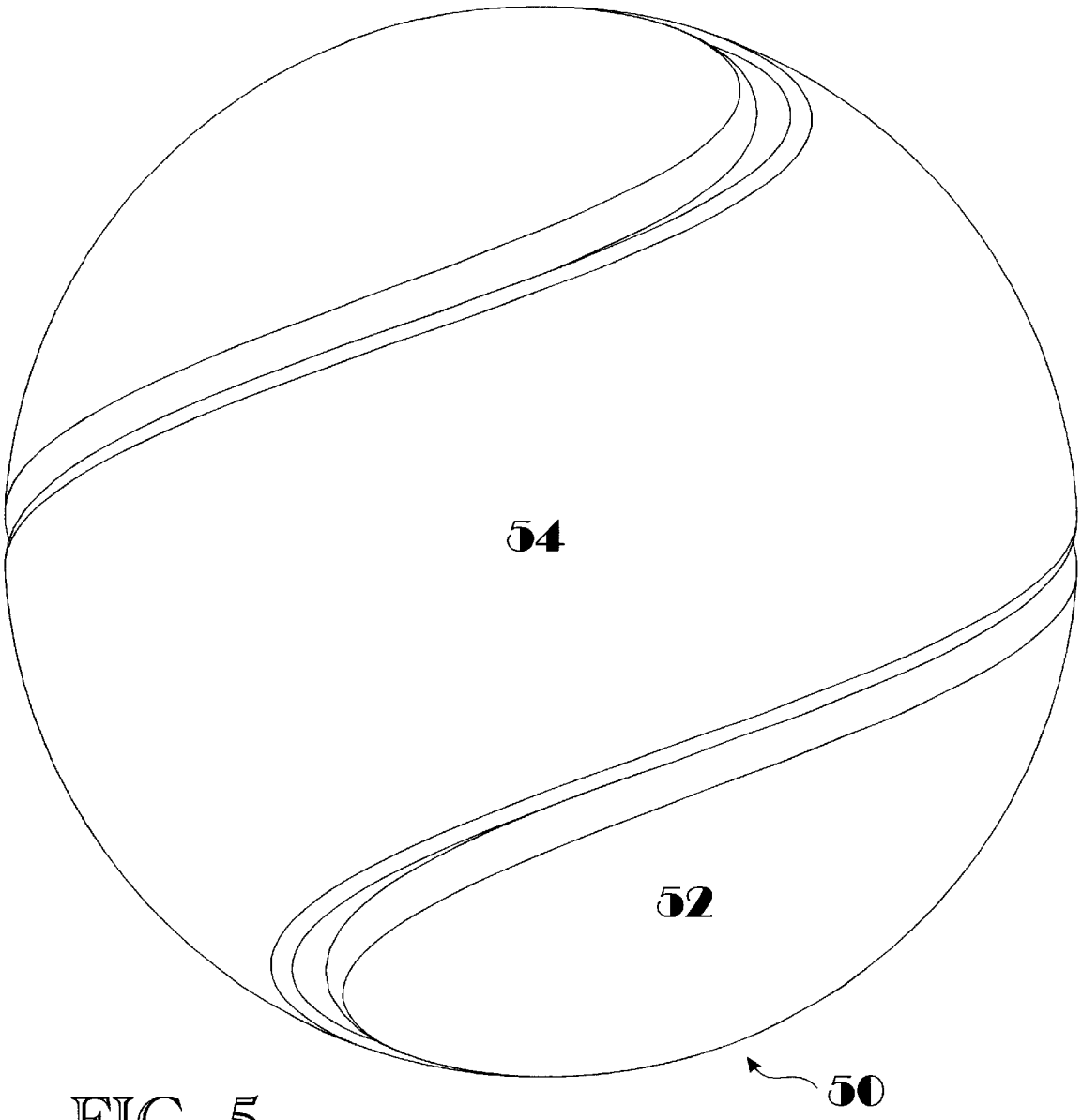
FIG. 5 is a perspective view of a globe (e.g. toy or novelty item) comprising two containers wherein each of the containers of the globe is arranged along a common vertical axis of the ensemble.

In practice, the number of containers present in the ensemble shall determine, in most instances, the extent to which each can be wound about the common axis of the ensemble in relation to one another. Generally, where only two containers are present in the ensemble, as shown in FIGS. 1, 3 & 5, the extent of torsional engagement of the discrete containers relative to one another, should be in excess of 270° and most preferably about 360°, to provide the requisite degree of physical coupling of the independent, discrete container to one another to maintain the integrity of the resulting ensemble. Alternatively, or in addition, to such torsional engagement, the common/contiguous surfaces of the discrete containers can be further provided with releasable, interlocking features (e.g. mating pairs of male and female surface features), to further engage and maintain the contiguous containers of the ensemble within a unitary configuration.

Each illustration of the ensembles of this invention has been depicted as having two spiral wound containers. It is understood that more than two discrete containers may be use in any of the ensembles depicted herein, subject of course to relative adjustment of their physical dimensions.

Figure 2A:
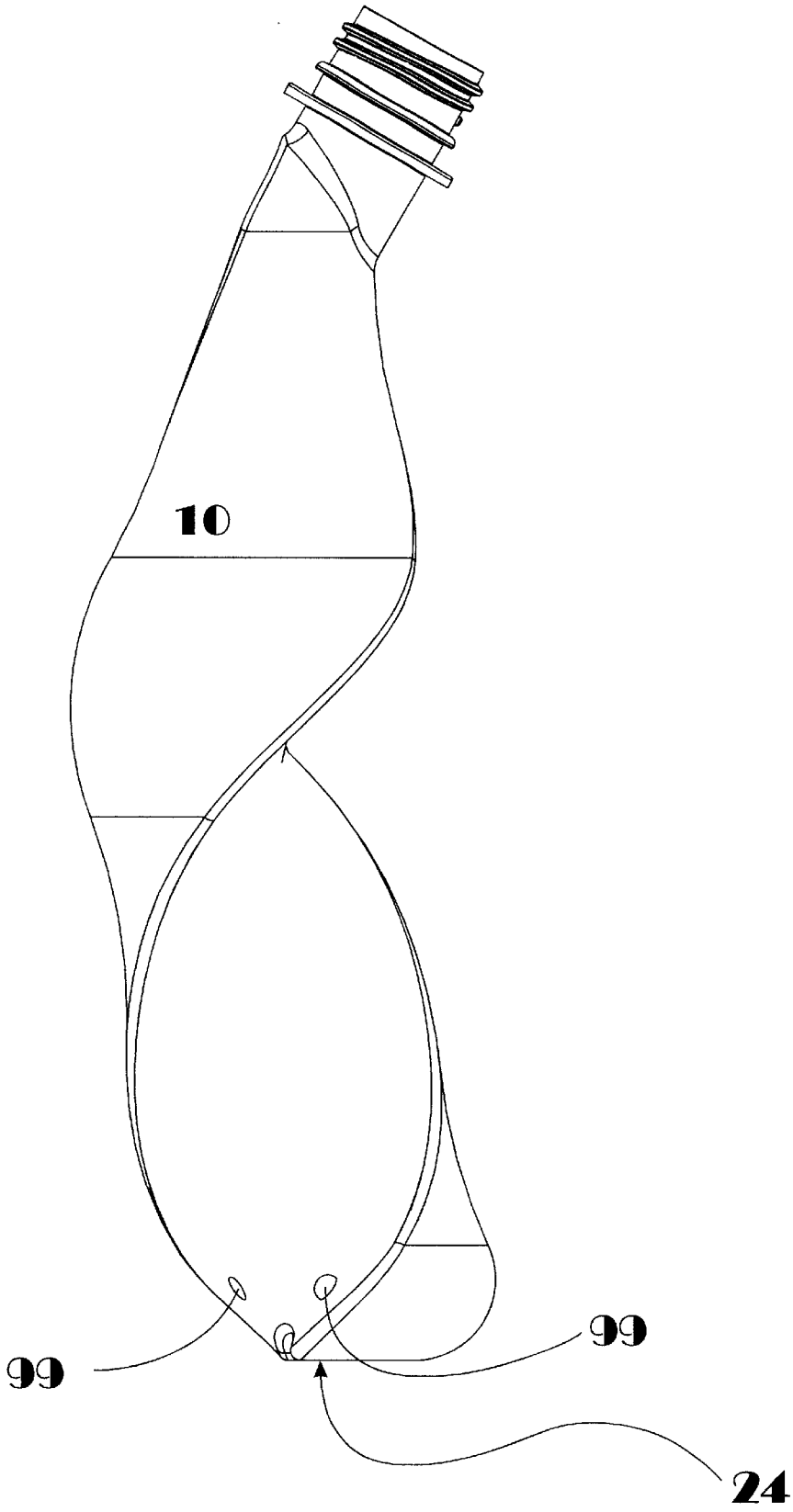
FIGS. 2A and 2B provide a perspective view of each of the containers of the ensemble of FIG. 1.
Figure 2B:
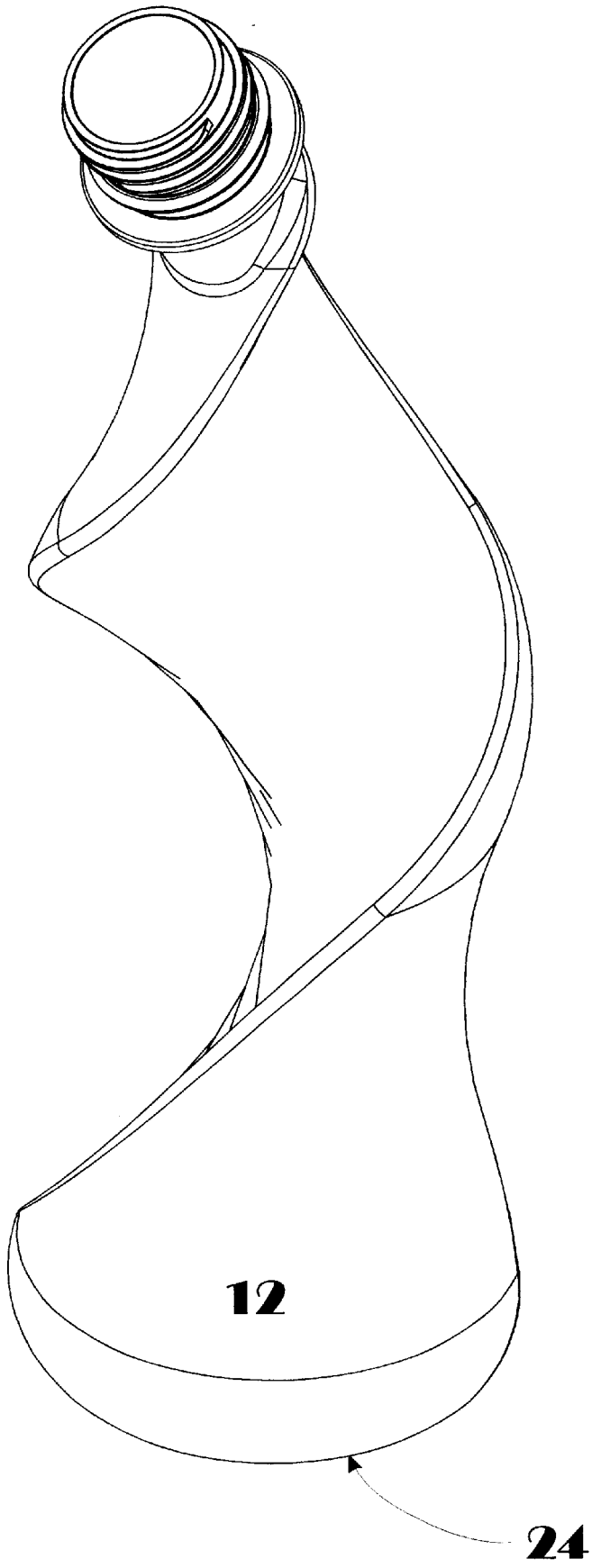

FIG. 1 depicts an ensemble comprising two identical, discrete containers (10, 12) that are spiral wound, in a counter clockwise direction, around a common vertical axis. In the embodiments of the invention illustrated in FIG. 1, each of the containers has a base (14), an intermediate section (16) and a neck (18). The open end (20) of the neck of the individual containers is shown to have a threaded surface (22) for acceptance of screw cap closure (not shown). The base (14) of each of the containers of the ensemble has a flatten surface (24) so as to permit a stable platform for maintenance of the ensemble in an erect position upon a supporting surface. The individual containers (10, 12) making up the ensemble of FIG. 1 are shown in FIG. 2.

It is contemplated that the individual containers of the ensemble be accessible for separate dispensing of the contents thereof, independent of the other members of the ensemble; and, most preferable, are also capable of independent support apart from the ensemble. More specifically, where the discrete containers of the ensemble are used to packaged companion beverage products (e.g. tequila and a margarita mix; vodka and tomato or orange juice, scotch and soda water, etc.) or ingredients which are typically combined based upon individual taste (e.g. vinegar and olive oil in salad dressings), it is preferable that each of the containers be free-standing independent of the other member of the ensemble. Thus, where the ensemble is placed upon a serving or dining room table, each of the discrete containers can be separately accessed and used by anyone of a number of individuals concurrently. As illustrated in FIG. 2, each of the discrete containers of the ensemble are also provided with releasable, interlocking features (99) (e.g. mating pairs of male and female surface features), to further engage and maintain the contiguous containers of the ensemble within a unitary configuration. The frequency and location of such surface features are effective to maintain the individual containers of the ensemble in a unitary form where the torsional engagement is insufficient to provide the requisite interlocking or coupling of the containers within the ensemble, or where the number of the containers present in the ensemble makes such surface features desirable to allow for removal of a single container from the ensemble without the remainder of the containers of the ensemble disengaging from one another.

It is also contemplated that such containers be decorative, and, thus, fabricated from transparent or tinted plastic or glass, so as to have added visual appeal in the setting in which they are to be used.

Figure 4:
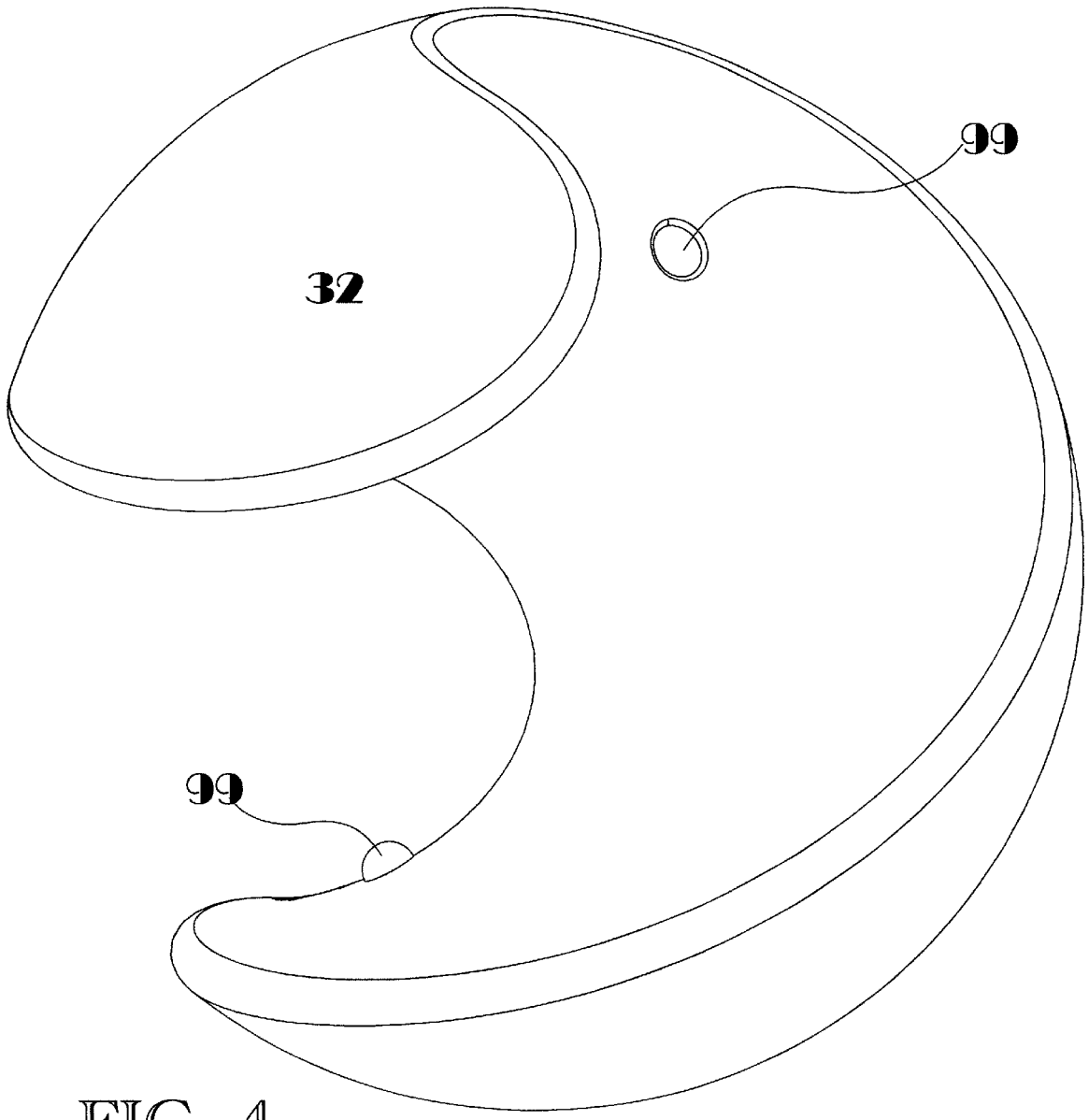
FIG. 4 is perspective view of the container units which comprise the ensemble of FIG. 3.

In the embodiments of the invention, in the form of novelty items or toys, illustrated in FIGS. 3–5, inclusive, the ensembles, specifically, the individual containers making up such ensembles, have limited utilitarian purpose other than as an adornment to add visual appeal to a table setting. Because of the discrete compartments provided by each container of the ensemble, the change in orientation of the ensemble on a supporting surface produces both a new and visually distinctive object with each such change in position. Thus, not unlike a kaleidoscope, the simple change in position of the ensemble produces a unique and visually attractive three dimensional solid sculpture having interlocking free-forms shapes. Accordingly, the novelty item and toy embodiments of this invention, contemplate that each of the containers not only have multiple, free-form shapes, but also that such containers be fabricated from transparent materials and thereafter filled with various colored fluids, or fluids within fluids More specifically, in the article depicted in FIG. 3, the ensemble comprises a globe (30) of essentially of uniform diameter. Where the discrete compartments (32, 34) are filled with colored liquid or solid, the rotation of the ensemble produces a myriad of combinations of visual effects that can provide attractive and varied solid sculptured objects without any other physical changes to the ensemble. In each instance, the globe would be supported on a base (not shown) to maintain it in the desired orientation relative to the supporting base. FIG. 4 depicts the individual container (32) used in the creation of the ensemble of FIG. 3. The versatility of the individual containers of FIG. 3 can be further enhanced, by inclusion of a dispensing feature (e.g. resealable closure) to permit changing the color of the fluid contained therein, although not necessary to realize the unique aesthetic qualities discussed above.

Figure 6:
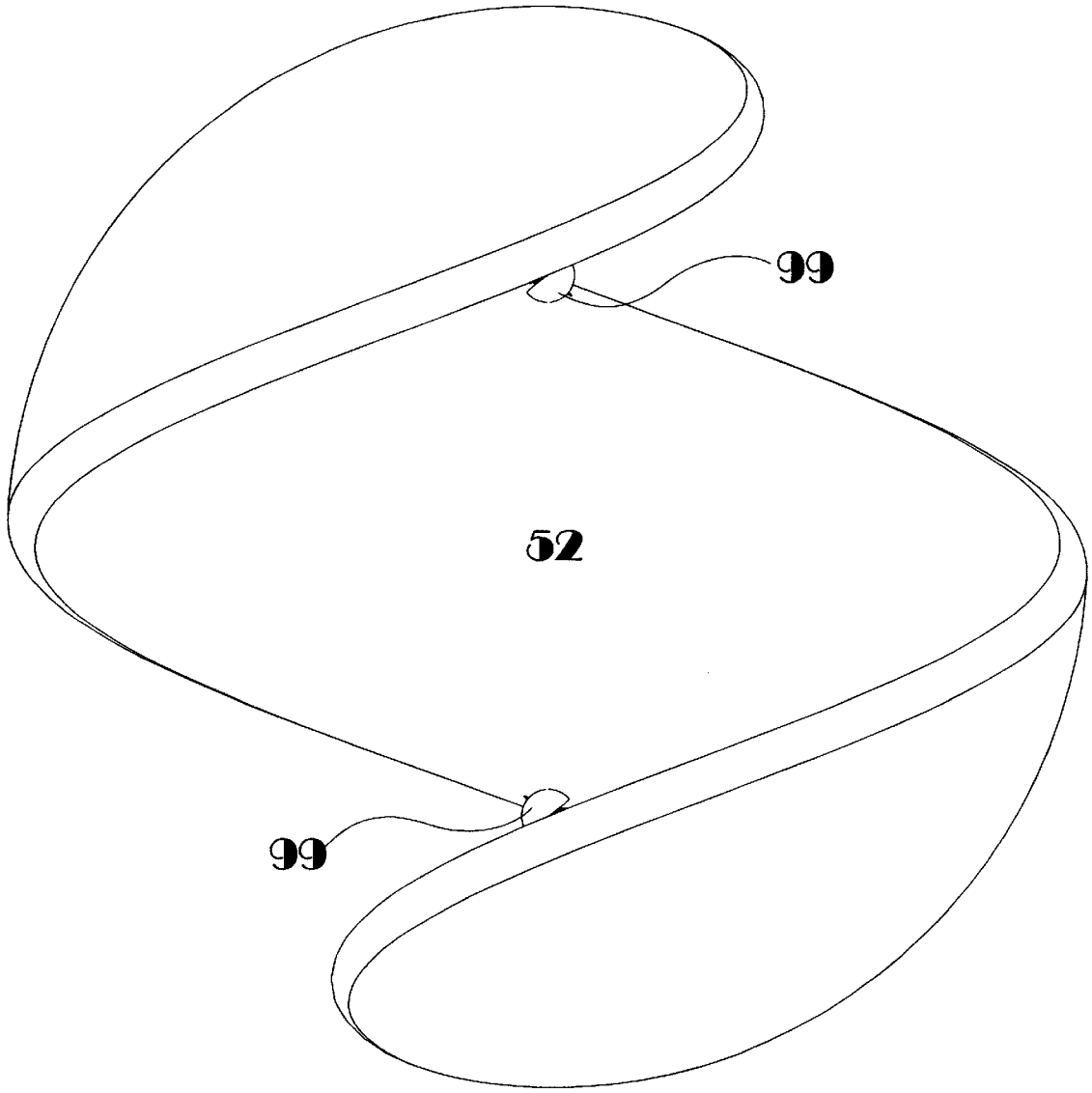
FIG. 6 is perspective view of the container units which comprise the ensemble of FIG. 5.

Similarly, the ensemble (50) of FIG. 5 provides similar creative possibilities. The individual container (52) of the ensemble of FIG. 5 is depicted in FIG. 6. In each of FIGS. 3 & 5, the number of containers can exceed the two shapes appearing in these figures, subject to relative adjustment in the physical dimensions of each of the containers making up the ensemble. The discrete containers of the ensemble can be further provided with releasable, interlocking features (99) (e.g. mating pairs of male and female surface features), comparable to the features illustrated in FIG. 2, to further engage and maintain the contiguous containers of the ensemble within a unitary configuration.

What is claimed is:

1. In an ensemble of multiple containers wherein two or more containers are physically combined in a unitary package and, thereafter, separable from one another incident to use or independent dispensing of the contents thereof from each container, the improvement comprising:

an ensemble comprising at least two essentially identical, discrete containers, wherein (a) each of said essentially identical discrete containers comprises a chamber having a base, an intermediate section and a neck, and (b) is spiral wound about a common axis relative to one another so as to provide effective torsional engagement of each container within said ensemble sufficient to retain each of said containers within said ensemble.

2. The improved ensemble of claim 1, wherein each of said containers is spiral wound at least about 270° around said common axis.

3. The improved ensemble of claim 1, wherein each of said containers is spiral wound at least about 360° around said common axis.

4. The improved ensemble of claim 1, wherein each of said containers is further provided with closure means for sealing and opening said discrete chamber of said container incident to filling or emptying said container.

5. The improved ensemble of claim 1, wherein each of said containers is further provided with a surface feature for mating engagement with a surface feature of another container within said ensemble.

6. The improved ensemble of claim 1, wherein each of said containers is free-standing when separate and apart from said ensemble.

7. The improved ensemble of claim 1, wherein each of said containers comprises a transparent, thermoplastic resin or glass.

8. The improved ensemble of claim 1, wherein each of said containers is filled with a beverage selected from the group consisting of a soft drink, wine, hard liquor, or a combination thereof.

9. The improved ensemble of claim 1, wherein each of said containers is filled with a different beverage that is selected from the group consisting of a soft drink, wine, hard liquor, or a combination thereof.

10. The improved ensemble of claim 1, wherein each of said containers is filled with a liquid selected from the group consisting of a colored fluid, a scented fluid, perfume, cologne, air freshener or a combination thereof.

11. In an ensemble of multiple containers wherein two or more containers are physically combined in a unitary package and, thereafter, separable from one another incident to use or independent dispensing of the contents thereof from each container, the improvement comprising:

an ensemble comprising at least two essentially identical, discrete containers, wherein (a) each of said essentially identical discrete containers comprises a chamber, and (b) is spiral wound about a common axis relative to one another so as to provide effective torsional engagement of each container within said ensemble sufficient to retain each of said containers within said ensemble.

12. The improved ensemble of claim 1, wherein each of said containers is spiral wound at least about 270° around said common axis.

13. The improved ensemble of claim 11, wherein each of said containers is spiral wound at least about 360° around said common axis.

14. The improved ensemble of claim 11, wherein each of said containers is further provided with closure means for sealing and opening said discrete chamber of said container incident to filling or emptying said container.

15. The improved ensemble of claim 11, wherein each of said containers is further provided with a surface feature for mating engagement with a surface feature of another container within said ensemble.

16. The improved ensemble of claim 11, wherein each of said containers is free-standing when separate and apart from said ensemble.

17. The improved ensemble of claim 11, wherein each of said containers comprises a transparent, thermoplastic resin or glass.

18. The improved ensemble of claim 11, wherein each of said containers is filled with a fluid selected from the group consisting of a colored fluid, a scented fluid, perfume, cologne, air freshener or a combination thereof.

* * * * *